US005723419A

United States Patent [19]

Czerwinski et al.

[11] Patent Number: 5,723,419

[45] Date of Patent: Mar. 3, 1998

[54] ENGINE TREATMENT COMPOSITION

[76] Inventors: James L. Czerwinski, 544 Lolumbine, Lisle, Ill. 60532; James P. Heidel, 1410 71st St., Downers Grove, Ill. 60516; Michael A. Schultz, 15259 Manor Ln., Lockport, Ill. 60441

[21] Appl. No.: 716,003

[22] Filed: Sep. 19, 1996

[51] Int. Cl.[6] ..... C10M 131/14

[52] U.S. Cl. ..... 508/589

[58] Field of Search ..... 508/589, 591

[56] References Cited

U.S. PATENT DOCUMENTS

| | | | |
|---|---|---|---|
| 2,322,209 | 6/1943 | Prutton | 508/589 |
| 3,322,672 | 5/1967 | Stanton | 508/589 |
| 4,200,543 | 4/1980 | Liston et al. | 252/32.7 E |
| 4,844,825 | 7/1989 | Sloan | 508/416 |
| 4,877,557 | 10/1989 | Kaneshige et al. | 508/472 |
| 5,332,516 | 7/1994 | Stephens | 508/585 |

*Primary Examiner*—Jerry D. Johnson

*Attorney, Agent, or Firm*—Baker & McKenzie

[57] ABSTRACT

A friction-reducing composition for the metal wear parts of an automobile engine composed of a chlorinated paraffin, natural petroleum base oil, synthetic di-ester base oil, a commercial detergent package and a viscosity index improver.

20 Claims, No Drawings

ENGINE TREATMENT COMPOSITION

The present invention relates generally to an engine treatment which assists in reducing metal wear of an internal combustion engine and, more specifically, to an engine treatment composition which employs as one of several indispensable elements, chlorinated paraffins as an extreme pressure lubricant. The engine treatment composition is admixed in the engine's oil reservoir and thus circulates to all moving parts which require lubrication. However, despite the high viscosity which chlorinated paraffins exhibit, the engine treatment product—once added to the oil reservoir—does not materially change the viscosity profile of the oil supply as a whole from the minimum specifications developed for motor oil.

BACKGROUND OF THE INVENTION

The American Petroleum Institute ("API") has for many years developed a series of performance standards for engine oils. The standard for gasoline engine oils used in passenger cars, vans and light trucks has changed over time as the engineering and performance characteristics of those engines have changed. API's current standard, Category SH, was adopted in 1992 to replace Category SG, adopted in 1989. The Society of Automotive Engineers ("SAE") also develops minimum viscosity profiles for different grades of motor oil, profiles which are incorporated in the ACI standards.

API's Category SH, like Category SG before it, sets forth a minimum viscosity profile for motor oils. The SH Category also provides performance minimums for motor oils in the areas of deposit control, oil oxidation, wear, rust and corrosion inhibition. Most motor oils for gasoline engines sold commercially today will bear a seal (or "donut") indicating that the oil passes the API SH standard.

The current SAE standards provide that an approved motor oil must have a certain viscosity profile at specific low and high temperature levels. At the low temperature range, the oil may not exceed a specified maximum viscosity, and at the high end the oil must have a viscosity profile within a specified range.

Most modern motor oils are multi-viscosity (i.e. a grade of motor oil that meets minimum SAE viscosity standards at both the high and the low end of the temperature range). The two most common grades of motor oil sold for passenger vehicles are 5W30 and 10W30 both of which are multi-viscosity oils that meet the minimum viscosity profiles throughout a specified range of temperatures. Motor oil with a 5W grade will have slightly better flowability at lower temperatures than a 10W30 grade oil. Automotive OEMs recommend 5W30 grade motor oil for use in most applications and 5W30 grade motor oil may be used in some vehicles in the wintertime, particularly in extremely cold areas. 10W30 grade oil is the most widely used, however. Both 5W30 and 10W30 grade motor oils contain "viscosity improvers", i.e. certain long chain polymers that allow the oil to meet both high and low end minimum viscosity profiles. The benefit of a multi-viscosity oil is that it can be used in hot and cold temperatures, i.e. different grades are not needed for winter and for summer.

In addition to meeting the minimum SAE viscosity profile, an API approved motor oil must meet certain performance specifications in the areas of deposit control, oil oxidation, wear, and rust and corrosion inhibition. Petroleum and synthetic oils do not, by themselves, meet these specifications, so commercially available oils will contain an additive "package" of detergents, inhibitors and other constituents which will allow the motor oil to meet the API SH category standard, and bear the API approved seal. Additive packages are approved by API and are commercially available from a number of sources.

A typical passenger car engine will have an oil reservoir of between four to five quarts. If the user utilizes an API approved multi-viscosity motor oil to fill the reservoir (such as 10W30), the resulting admixture will meet minimum SAE viscosity profile standards (throughout the entire range of temperatures) and also provide the minimum performance specifications as set forth by API with respect to deposit control, etc.

Although API approved motor oil has excellent properties, ways have constantly been sought to improve the performance of motor oil, particularly in the area of metal wear reduction during extreme pressure conditions. During extreme pressure conditions, the lubricating wedge of motor oil begins to dissipate, increasing the potential for wear in metal to metal applications. There are a number of "engine" or "oil" treatments which involve adding constituents not found in an API approved motor oil to the oil reservoirs. The active ingredients of such treatments vary, as does their performance; some treatments utilize PTFE as one of the active ingredients. Other treatments use chlorinated paraffins as the active ingredient; chlorinated paraffins have long been known to have lubricating properties in metal-to-metal conditions, particularly under extreme pressure conditions.

An example of such a composition is found in Stephens, U.S. Pat. No. 5,332,516, which discloses a friction reducing composition which comprises between 75% and 95% by volume of a chlorinated paraffin, between about 2% to 25% of a rust inhibitor composition, and about 0.2% of an antimicrobial compound.

U.S. Pat. No. 4,844,825 to Sloan discloses a lubrication additive for motor oils which comprises between 30% and 70% by volume of chlorinated paraffin, between 30% and 70% by volume of mineral oil and/or mineral spirits and/or an aromatic solvent, and between 0.5% and 10% by volume of an alkaline earth metal sulfonate.

U.S. Pat. No. 4,877,557 to Kaneshige et al. discloses a lubricating oil composition which comprises a synthetic base oil, a load withstanding additive (including, inter alia, chlorinated paraffin), and a particular liquid modified copolymer.

All of these compositions claim to take advantage of the benefits of chlorinated paraffins in extreme pressure conditions. However, none of these patents adequately compensate for the fact that chlorinated paraffins have a very high viscosity such that when it is added to the oil reservoir in these quantities, the resulting oil will be immediately thrown "out of grade", i.e. the oil will not meet the SAE viscosity profile. Further, these compositions do not take into account the effect the treatment product has on the level of the API "package" of additives; the addition of the treatment product dilutes the reservoir and thereby lowers the levels of the API approved package.

Commercially available chlorinated paraffins have a higher viscosity than an API approved multi-viscosity motor oil. Most commercially available chlorinated paraffins will have a chlorine content of between 20% to 70%; the higher the chlorine content, the higher the viscosity and specific gravity of the compound. Therefore, when one adds a chlorinated paraffin to an API approved multi-viscosity motor oil, the viscosity of the resulting admixture changes dramatically, and the resulting admixture will not meet the SAE minimum viscosity profiles part of the API SH or SG standards. Engine treatments which call for the addition of a small amount of highly chlorinated paraffin solution directly to an existing oil reservoir will result in a dramatic change to the overall viscosity profile of the oil reservoir, a viscosity profile which will not meet SAE minimum standards.

Some treatment compositions which contain chlorinated paraffin as an active ingredient will dilute the chlorinated paraffin in base oil; in some commercially available engine treatments, a one quart mixture of the treatment containing chlorinated paraffin and a carrier base oil will be added in lieu of or to displace one quart of motor oil in the oil reservoir. However, these engine treatments still change the viscosity profile of the resulting admixture so it is not in compliance with minimum SAE (and thus API) standards.

In addition, if the chlorinated paraffins are mixed with a large volume of base oil to form the additive, the addition of the composition will reduce the concentration of the API approved inhibitor/detergent package by as much as 20% to 25% depending on the size of the oil reservoir and the volume of the additive. For example, some commercially available engine treatment products call for the use of one quart of the composition, to replace one quart of oil in the engine's reservoir. Because the treatment does not contain a full API approved inhibitor/detergent package, the resulting admixture will not meet API category standards.

Hence, although the use of chlorinated paraffins is desirable as a constituent in engine oil treatment, there is a need for a composition which not only utilizes chlorinated paraffin, and takes advantage of its known benefits, but one which keeps the oil generally "in grade" and maintains the full API package of additives at their specified levels.

SUMMARY OF THE INVENTION

Hence, the present lubricating composition was developed to fully utilize the positive benefits of chlorinated paraffins under extreme pressure conditions, yet keep the engine's entire oil supply generally within SAE approved viscosity profiles. The present composition was also developed to be simple and economical in manufacture, and simple to use. The composition is added to the crank case of an engine to displace and/or in lieu of an equivalent amount of an API approved multi-viscosity motor oil.

The preferred composition comprises a base oil, chlorinated paraffin, a full API approved detergent/inhibitor package, and a viscosity index improver. By adding these ingredients, in the prescribed percentages, to a volume of standard motor oil wherein the additive/oil ratio is approximately 4 to 1, the present composition maximizes the lubricating effect of the chlorinated paraffin without materially affecting the SAE approved viscosity criteria for a multi-viscosity motor oil, and maintaining the full concentration of the API additive package.

DETAILED DESCRIPTION OF THE PREFERRED EMBODIMENT

The preferred form of chlorinated paraffin used in the present invention has from 10 to 14 carbon atoms in the chain and comprises approximately 40% to 70% active chlorine. The preferred form of chlorinated paraffin has between 12 and 14 carbon atoms with between about 61% to about 63% active chlorine. The chlorinated paraffin is present in the range of about 16% to about 20% by volume, with a percentage of about 18% by volume being particularly preferred.

In order to counteract the viscosity of the chlorinated paraffin present in the instant composition, the chlorinated paraffin is blended with neutral and synthetic base oils so that the admixture resulting from the use of the composition will generally meet the SAE viscosity profile for 10W30 motor oils. The preferred embodiment consists of a blend of neutral base oil and synthetic oil to make the composition economical and to meet the applicable viscosity profile. The synthetic oil can be a diseter, a polyol ester, or a poly alcohol olefin. A blend of neutral base oil and synthetic base oil is preferred because synthetic base oil is significantly more expensive than petroleum based neutral oil; a blend is far more economical. The preferred embodiment includes about 10% of a synthetic di-ester base oil (by volume) and about 55% (by volume) of a neutral base oil. The base oil is between about 60 second and about 200 second, with about 100 second base oil being particularly preferred.

The preferred form of the composition also includes a viscosity index improver (VI Improver) in the amount of about 5% by volume in the composition such as an olefin copolymer or an alkyl methacrylate. In a particularly preferred embodiment, the VI Improver is an alkyl methacrylate. The VI Improver, along with the neutral base oil/synthetic oil blend ensures than the engine's entire oil supply will meet the multi-viscosity requirements for engine oils by maintaining the proper viscosity index once one quart of motor oil is replaced by one quart of the present composition.

The preferred composition also contains a full API approved additive package utilized in one quart of 10W30 or 5W30 motor oil. An example of such a package is the commercial detergent package sold under the designation APISH-CD by Texaco. This detergent package, typical of a variety of similar commercially-available products, is included in the composition in the amount of about 12% by volume. The inclusion of a full API approved additive package means that the engine's entire oil supply will maintain the minimum API viscosity criteria after one quart of motor oil is displaced by one quart of the composition of the present invention.

The composition of the present invention has a unique formulation which, as compared to other engine treatment or oil treatment products, maintains a balance of necessary oil additive ingredients and by its mere addition to an oil reservoir does not result in dilution of essential motor oil ingredients, or a material change in the critical viscosity profile. In addition, the present composition is specially formulated with a mix of conventional base oils and a synthetic di-ester base oil that, in combination, provide flowability in cold temperatures and synergistically works with the motor oil in cold and hot temperature extremes to maintain the oil's multi-viscosity profile. The composition is also compatible with all oils that meet API SH and SG category standards.

Comparative testing was conducted to demonstrate the efficacy of the present invention. A composition in accordance with the present invention with the following ingredients was utilized:

| INGREDIENT | % BY VOLUME |
|---|---|
| 100 second natural base oil | 56% |
| chlorinated paraffin (C12–C14 chain length) | 18% |
| alkyl methacrylate | 5% |
| APISH-CD Texaco Additive | 12% |
| Synthetic di-ester base oil | 10% |

This composition was admixed with API certified 5W30 grade motor oil in a 1:4 ratio. The admixture did not materially depart from the relevant SAE viscosity profile for 5W30 motor oil. The admixture was tested, along with the same 5W30 grade oil (without augmentation) using a modified L-38 Oxidation Test Procedure as specified by ASTM 5119-90. The ASTM procedure was modified to determine rod bearing wear (i.e. metal loss) in the engine treated with a state of the art 5W30 motor oil, compared with rod beating wear (i.e. metal loss) in an engine treatment with the composition of the present invention.

In each case, the test engine was run for twenty hours; the engine was broken down and rod bearing wear measured as metal loss. The results demonstrated that the metal loss (on the bearings) from the test bearings for the engine treated just with motor oil was 6.8 mg compared to metal loss (on the bearings) for the engine treated with the composition of the instant invention was 2.4 mg.

While the present invention has been described in detail according to the preferred embodiment disclosed in the foregoing description, it will be apparent to those skilled in the pertinent art that variations and equivalents may be made within the spirit and scope of that which has been expressly disclosed. Accordingly, it is intended that the scope of the invention be limited solely by the scope of the hereafter appended claims and not by any specific wording in the foregoing description.

We claim:

1. A composition for addition to the oil supply of an internal combustion engine which comprises:

(a) between about 60% and about 72% by volume of a base carrier oil;

(b) between about 16% and about 20% by volume of a chlorinated paraffin;

(c) between about 1% and about 10% by volume of an olefin copolymer wherein the resulting admixture has an overall viscosity profile which is not materially different than the viscosity profile of the oil supply's grade.

2. The composition of claim 1, wherein said chlorinated paraffin comprises approximately 18% by volume of said composition.

3. The composition of claim 1 which additionally includes between about 10% and about 14% by volume of a full API certified detergent inhibitor package.

4. The composition of claim 3, wherein said API certified detergent inhibitor package comprises approximately 12% by volume of said composition.

5. The composition of claim 1, wherein said olefin copolymer comprises approximately 5% by volume of said composition.

6. The composition of claim 1, wherein said base carrier oil is comprised of a combination of 100 second natural petroleum oil and a synthetic di-ester carrier oil.

7. The composition of claim 1 wherein said chlorinated paraffin has between about 40% and about 70% active chlorine.

8. The composition of claim 7 wherein said chlorinated paraffin has between about 61% and about 63% active chlorine.

9. A supply of oil to fill the crank case of an internal combustion engine, said supply consisting essentially of:

(a) approximately 80% by volume of a conventional motor oil; and (b) approximately 20% by volume of the composition as defined in claim 1.

10. A supply of oil to fill the crank case of an internal combustion engine, said supply consisting essentially of:

(a) approximately 80% by volume of a conventional motor oil; and (b) approximately 20% by volume of the composition as defined in claim 5.

11. A composition for addition to the oil supply of an internal combustion engine consisting essentially of:

(a) between about 50% and about 62% by volume of a 100 second natural petroleum oil;

(b) between about 16% and about 20% by volume of a chlorinated paraffin;

(c) between about 10% and about 14% by volume of a full API certified detergent package;

(d) between about 4% and about 16% by volume of a synthetic di-ester base carrier oil; and (e) between about 1% and about 10% by volume of an olefin copolymer.

12. The composition of claim 11, wherein said chlorinated paraffin is approximately 18% by volume of said composition.

13. The composition of claim 11, wherein said API certified detergent package is approximately 12% by volume of said composition.

14. The composition of claim 11, wherein said 100 second natural petroleum oil is approximately 56% by volume of said composition.

15. The composition of claim 11, wherein said synthetic di-ester base carrier oil is approximately 10% by volume of said composition.

16. The composition of claim 11, wherein said olefin copolymer is approximately 5% by volume of said composition.

17. The composition of claim 11 wherein said chlorinated paraffin contains between about 40% to about 70% active chlorine.

18. The composition of claim 17 wherein said chlorinated paraffin contains between about 61% and about 63% active chlorine.

19. A supply of oil to fill an automobile crank case, said supply consisting essentially of:

(a) approximately 80% by volume of a conventional motor oil; and (b) approximately 20% by volume of the composition as defined in claim 15.

20. A supply of oil to fill an automobile crank case, said supply consisting essentially of:

(a) approximately 80% by volume of a conventional motor oil; and (b) approximately 20% by volume of the composition as defined in claim 8.

* * * * *